United States Patent [19]

Anderson

[11] Patent Number: 4,585,170

[45] Date of Patent: Apr. 29, 1986

[54] BACK FLASH PREVENTER FOR A POWDER SPRAY TORCH

[76] Inventor: James Y. Anderson, 1838 Cliffhill Dr., Monterey Park, Calif. 91754

[21] Appl. No.: 638,851

[22] Filed: Aug. 8, 1984

[51] Int. Cl.[4] ..... B05B 1/24

[52] U.S. Cl. ..... 239/85; 239/288

[58] Field of Search ..... 239/85, 79, 80, 288, 239/288.3, 288.5; 431/346; 220/88 R, 88 A, 366, 367; 48/56, 175

[56] References Cited

U.S. PATENT DOCUMENTS

| | | | |
|---|---|---|---|
| 1,002,752 | 9/1911 | Rand | 239/288.3 X |
| 1,075,053 | 10/1913 | Moore | 239/288.5 X |
| 3,396,746 | 8/1968 | Hawk, Sr. | 239/80 X |
| 3,415,449 | 12/1968 | Hawk, Sr. | 239/85 |
| 3,436,019 | 4/1969 | Hawk, Sr. | 239/85 |
| 3,476,320 | 11/1969 | Fleischhacker et al. | 239/85 |

*Primary Examiner*—Johnny D. Cherry
*Assistant Examiner*—Daniel R. Edelbrock
*Attorney, Agent, or Firm*—Sellers and Brace

[57] ABSTRACT

Disclosed is an improved back flash preventing device for a powder spray torch wherein the improvement comprises a structure constructed to thwart attempts by the user to block the outlet end or atmosphere vent of the back flash preventer. This is accomplished by providing the outlet of the vent with a guard so constructed as to prevent the user closing the outlet with his finger, a covering tape or the like.

3 Claims, 2 Drawing Figures

BACK FLASH PREVENTER FOR A POWDER SPRAY TORCH

BACKGROUND OF THE INVENTION

Figure 1:
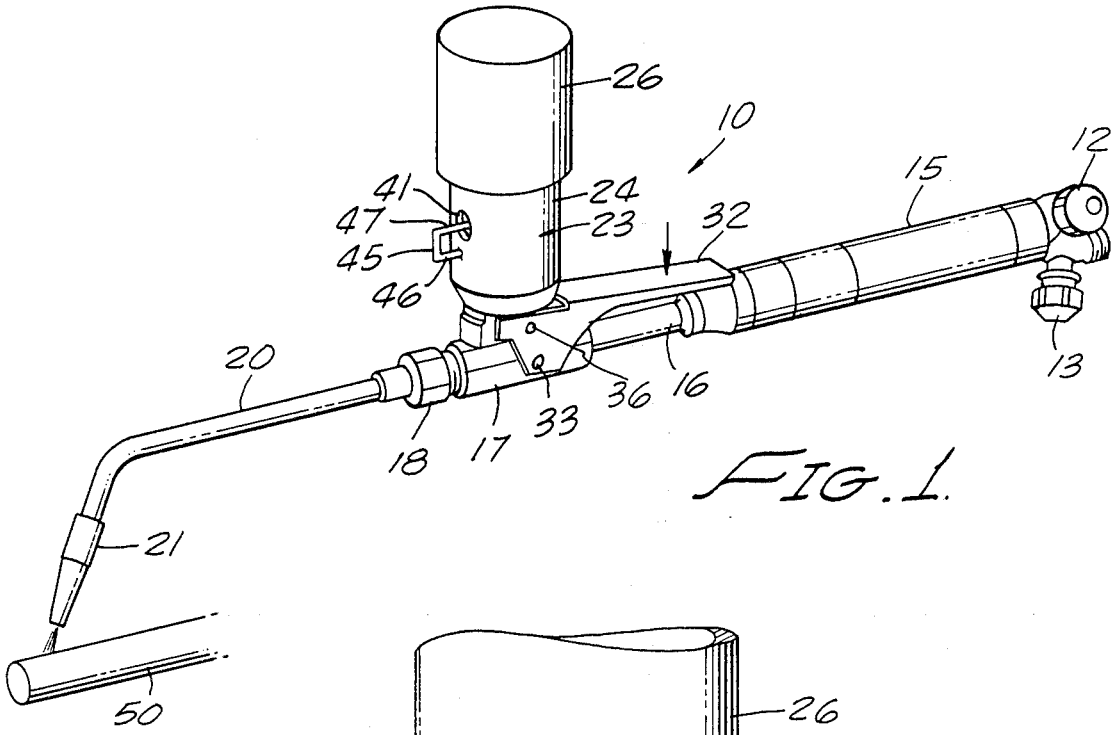

Oxyacetylene torches designed for powder spraying are sometimes subject to back flash if the torch tip encounters an obstruction, or is accidentally advanced too close to the workpiece or is subjected to a sudden change in ambient pressure conditions in the vicinity of the torch outlet. Such back flashes can be quite hazardous to the workman and can result in an explosion in the powder reservoir or in the loss of powder to the atmosphere.

Various proposals have been made to arrest such back flashes or to minimise the potentials for injury to the equipment or to personnel. Usually such expedients provide means for shunting the back flash pressures to the atmosphere in some manner bypassing the powder contents of the reservoir. Examples of such expedients are disclosed in U.S. Pat. Nos. to Fleischhacker et al 3,476,320; and Hawk 3,415,449. These and the like expedients have proven quite satisfactory in use but some users find it a simple matter to circumvent or deactivate the safety device by applying a cover or other sealant means over the outlet end of the back flash preventer. Usually this outlet is associated with the power feed tube and is in communication with the atmosphere through the sidewall of the powder container or hopper and is so constructed as to avoid loss of powder while quickly and freely venting back flash pressure to the atmosphere independently of the main powder supply. Such a cover renders the back flash preventer inoperative and poses dangerous conditions for both the equipment and the operator.

SUMMARY OF THE INVENTION

The present invention provides an exceedingly simple but highly effective means for thwarting an attempt by a torch user to deactivate its back flash preventer typically incorporated in all modern powder spray torches. To this end the invention provides a rugged barrier projecting from the outer wall of the powder feed hopper in an area closely adjacent the outlet of the back flash preventer. A portion of this barrier projects into the outlet opening of the back flash preventer without obstructing the same thereby effectively thwarting any attempt to apply a cover blocking the outlet opening.

Accordingly, it is a primary object of this invention to provide the power feeding facility of a powder spray torch with a barrier thwarting the attempts of users to deactivate the flash back preventer.

A further and more specific object of the invention is to provide the atmospheric vent port of a back flash preventer for a powder spray torch with a U-shaped barrier having one leg extending axially into the vent port and the remainder lying substantially outwardly of the vent port and anchored to the powder hopper wall.

These and other more specific objects will appear upon reading the following specification and claims and upon considering in connection therewith the attached drawing to which they relate.

Figure 2:
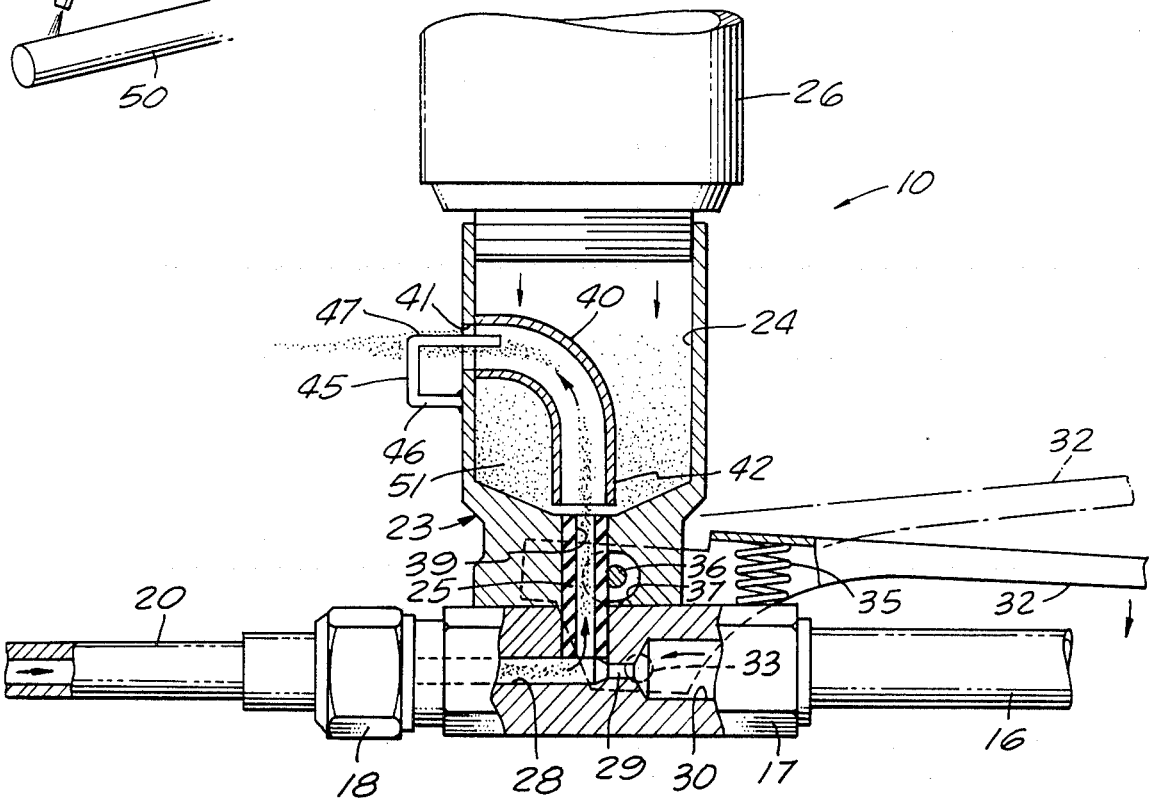

Referring now to the drawing in which a preferred embodiment of the invention is illustrated:

FIG. 1 is a perspective view of a powder spraying torch showing the invention expedient for preventing an operator from deactivating the flash back preventer; and FIG. 2 is a cross sectional view on an enlarged scale taken through the flash back preventer facility of the torch shown in FIG. 1.

Referring initially more particularly to FIG. 1, there is shown a typical oxyacetylene powder spraying torch designated generally 10 incorporating a back flash preventer equipped with the barrier device in accordance with an illustrative embodiment of this invention. Torch 10 is of generally conventional design having inlet lines, not shown, for oxygen and for acetylene respectively controlled by separate valves 12 and 13. Appropriate quantities of these two gases enter a mixing chamber 15 of known construction having its outlet connected by conduit 16 to the T-shaped fitting 17. The outlet at the lefthand end of this fitting is connected by threaded coupling 18 to a tube 20 provided at its discharge end with a detachable nozzle 21.

The T-shaped fitting 17 may be formed in a pair of components or in a single casting. The laterly extending or T-stem portion 23 is provided with a tubular hopper 24 having a converging bottom opening into a powder feeding passage comprising a short length of elastomeric tubing 25. The upper end of hopper 24 is threaded or otherwise contoured to support the outlet end of a detachable powder storage cartridge 26 containing metallic or fusable powder adapted to be deposited on a workpiece after discharged in a highly heated condition from nozzle 21. The upper end of the elastomeric feed tube and powder valve 25 is flush with the bottom of the hopper and its lower end opens into the oxyacetylene gas passage 28 closely adjacent the forward end of a venturi passage 29 in communication with the oxyacetylene feed passage 30 in communication with tube 16.

As shown in FIG. 2, a channel shaped powder feed control lever 32 straddles fitting 17 and is pivotally connected thereto by aligned pivot screws 33. A compression spring 35 normally urges this lever to pivot to the dot and dash line wherein it is effective to collapse the elastomeric tube 25 and cut off powder flow in a manner well known to those skilled in this art. This is accomplished by a cross pin 36 extending through a large diameter opening 37 crosswise of fitting 17 thereby collapsing the right hand sidewall of this tube against it opposite side to close off the powder feed passage 39.

Hopper 23, 24 is provided with a back flash preventer comprising a tubular elbow 40 having its upper or outlet end rigidly connected to the hopper sidewall and in communication with the atmosphere vent port 41. The opposite or lower end of elbow 40 is aligned with the powder feed passage and is closely spaced from the hopper outlet by an amount found suitable to restrict the flow of powder. Typically, this spacing is 20 to 40 mils but varies widely depending on the powder being used and other operating conditions.

The vent port 41 of the back flash preventer opens to the atmosphere and serves to admit air into the powder hopper as powder is consumed without risk of loss of powder during normal operation of the torch. The operator customarily manoeuvres the torch with the powder supply overlying the torch and is effective to permit gravity feed of the powder into the oxyacelylene gas stream. To thwart any attempt by the user to block the venting port 41, there is provided a rugged barrier here shown by way of example as a rigid U-shaped member 45 having one leg 46 firmly secured to the sidewall of hopper 23 and its other leg 47 projecting axially through port 41 and into the adjacent upper end of elbow 40.

In operation, torch 10 is used in the manner well known to persons skilled in the art of metal coating using oxyacelylene or the like powder spray torches. So long as the torch is not in use the powder feed lever 32 is urged counterclockwise by spring 35 to the dot and dash line position shown in FIG. 2, wherein its cross pin 36 collapses elastomeric tube 25 to close off powder feed. After the torch has been placed in use and the workpiece 50 has been heated by the torch the operator depresses control lever 32 allowing tubing 25 to expand sufficiently to allow powder flow at a desired flow rate. Powder 51 then flows into the upper end of this tube and is entrained by the partial vacuum existing at the outlet end of venturi 29. The powder is transported in suspension in the gas stream to the nozzle 21 and is heated to a fluent state by the torch flame and the hot area of the workpiece.

Should the nozzle outlet become partially obstructed it is possible for the flame to propagate backwardly through the nozzle and tube 20. Under these conditions the backflash can pass upwardly through the powder feed tube which opens into the much larger bore of the back flash preventer elbow 40. A small amount of powder then present in this back flash is vented to the atmosphere through venting port 41 and is prevented from passing into the powder container. This momentary back flash and exhaust of powder and hot gas into the atmosphere is disturbing to some operators. To avoid such a happenstance, some incautious workmen attempt to seal the venting port 41 by applying a cover thereover. However, the barrier 45 of this invention thwarts any attempt to do so for reasons made self evident by the showing in FIGS. 1 and 2. It will be recognized that the barrier 45 may take other configurations but the U-shaped rigid member shown is very simple, rugged and has been found to serve the intended purpose in a highly satisfactory manner.

While the particular improved back flash preventer for a powder spray torch herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. In a powder feeding device for feeding powdered metal to a powder spray torch of the type having a powder hopper having a powder outlet equipped with means for detachably coupling a powder container thereto, a back flash safety tube mounted within said hopper having a first end axially aligned with said powder outlet and closely spaced therefrom to permit powder flow into said powder outlet and a second end secured to said hopper and opening through the wall thereof to the atmosphere, said back flash safety tube being characterized in the provision of rigid guard means projecting outwardly from said second end thereof and constructed and arranged to thwart efforts of the user to close said second end of said safety tube.

2. A powder feeding device as defined in claim 1 characterized in that said guard means is anchored to a wall of said hopper and includes a portion bridging at least a portion of said second end of said safety tube in an area spaced outwardly therefrom thereby providing negligible interference with the escape of back flash constituents from said safety tube.

3. A powder feeding device as defined in claim 2 characterized in that said guard means comprises a rigid U-shaped member having one leg anchored in said hopper wall and the other leg projecting generally axially into said second end of said safety tube.

* * * * *